US007717082B2

(12) United States Patent
Mullin

(10) Patent No.: US 7,717,082 B2
(45) Date of Patent: May 18, 2010

(54) PRIME MOVER WITH INTEGRAL OIL RESERVOIR

(76) Inventor: William B. Mullin, Rt. 1, P.O. Box 242, Graham, TX (US) 76450

( * ) Notice: Subject to any disclaimer, the term of this patent is extended or adjusted under 35 U.S.C. 154(b) by 383 days.

(21) Appl. No.: 11/924,797

(22) Filed: Oct. 26, 2007

(65) Prior Publication Data

US 2009/0107267 A1 Apr. 30, 2009

(51) Int. Cl.
*F01M 1/02* (2006.01)

(52) U.S. Cl. ..... 123/196 R; 123/198 E; 184/6.13

(58) Field of Classification Search ..... 123/196 R, 123/195 C, 198 E
See application file for complete search history.

(56) References Cited

U.S. PATENT DOCUMENTS 2,381,839 A 8/1945 Salsibury ..... 184/6
3,247,798 A 4/1966 Glasgow et al. ..... 103/6
3,658,153 A 4/1972 Berman ..... 184/6.3
5,567,306 A 10/1996 De Wachter ..... 210/168
5,782,315 A 7/1998 Reinosa ..... 184/6.3

*Primary Examiner*—Noah Kamen
(74) *Attorney, Agent, or Firm*—Charles D. Gunter, Jr.

(57) ABSTRACT

A prime mover is shown which can be used in supplying power for a variety of roles in industrial applications, including oil and gas well operations, such as the prime mover which is used to operate a pump jack at a well site. It includes an internal combustion engine having an output shaft, the engine being cooled by engine oil supplied from an oil reservoir to the engine and circulated by an oil pump. A housing framework encloses the engine and supports an associated jack shaft bearing assembly, and includes a base, a hood and a plurality of upright supports which extend upwardly from the base in the direction of the hood. One or more of the uprights is a specially designed compartment having a plurality of opposing sides which define an initially open interior space, the interior space comprising an integral oil reservoir for storing and supplying oil to the engine during normal engine operation.

13 Claims, 5 Drawing Sheets

PRIME MOVER WITH INTEGRAL OIL RESERVOIR

BACKGROUND OF THE INVENTION

1. Field of the Invention

The present invention relates generally to an improved design for a prime mover of the type used in supplying power for a variety of roles in industrial applications, including oil and gas well operations, such as the prime mover which is used to operate a pump jack at a well site, or which is used to operate an injection well.

2. Description of the Prior Art

Oil and gas well production operations require a variety of different power sources for such things as running gas compressors, running of injection wells, or operating the pump jack present at the well site. Pump jacks are widely used at the present time at the surface of an oil well to reciprocate lift pumps, located downhole in the well, for lifting subsurface fluids to the surface of the well. A lift pump usually includes a tubular barrel and a cooperating plunger assembly which reciprocates within the barrel. The plunger assembly is attached to a rod string which extends to the surface of the well and by which the plunger assembly may be reciprocated by the pump jack.

A typical pump jack may comprise a supporting post and a walking beam, having a head end and a tail end, pivotally connected to the post to allow for rocking of the beam about a horizontal pivot axis between one position, in which the head end is up and the tail end is down, and another position in which the head end is down and the tail end is up. It is the head end which is normally connected to the upper end of a vertical pump rod string, at the lower end of which is the lift pump. The walking beam is typically connected to one end of an arm, the opposite end of which connected to a drive assembly. The drive assembly provides the motive force to rock the beam about its horizontal pivot axis to reciprocate and produce a predetermined number and rate of up and down strokes of the pump rod string. The drive assembly typically includes a rotating power device which will be referred to in the discussion which follows as a "prime mover." The prime mover is typically either an electric motor or a gas combustion engine and is typically connected by sheaves and belts to a power transmission assembly, e.g. a gear box, whereby rotation of the prime mover's output shaft is translated to a longitudinal force on the arm for rocking of the beam. Pump jacks of this type are well known in the oil and gas industry, having been used for many years. Examples of such pump jacks may be seen in the following U.S. Pat. Nos. 4,238,966; 4,454,778; 4,492,126; 4,723,452 and 4,743,172, among others.

The present invention deals with the prime mover component which is used for such tasks as operating the pump jack in the manner previously described. Despite advances which have been made over the years in the design of prime movers of the type under consideration, a need continues to exist for further improvements.

It would be particularly advantageous to provide such a prime mover which could be run on common oil field fuels, including natural gas, propane, or methane, and which offered an improved design for maximizing production and increasing labor efficiency of the device when used in oil field and industrial pumping operations.

Additionally, one particular area in need of improvement in many of the existing prime mover designs is the oil supply system of the unit. It would be particularly advantageous to provide a prime mover with one or more oil reservoirs for storing and supplying oil to the engine of the prime mover. Increasing the volume of oil available would extend the time period between required oil changes. It would also keep the engine cooler during normal operation, thereby extending the engine life.

It would also be advantageous to provide the aforesaid oil reservoirs for the engine of the prime mover with the reservoirs being integrated into the design of the housing framework of the prime mover itself, rather than being externally located. This would result in a simplified design which would provide economy of manufacture.

SUMMARY OF THE INVENTION

The prime mover of the invention can be used to supply power in a variety of industrial applications, such as would be found on an oil or gas well drilling and production site. The prime mover of the invention includes an internal combustion engine having an output shaft, the engine being cooled by engine oil supplied from an oil reservoir to the engine and circulated by an oil pump. In the environment of use of the prime mover as a part of the pump jack installation at a well site, a jack shaft is mounted in a bearing assembly which allows rotational movement of the jack shaft. A sheave is mounted on the jack shaft, the sheave being connected to an output shaft of the internal combustion engine by a drive belt. A housing framework encloses both the engine and jack shaft bearing assembly, the housing framework including abase, a hood and a plurality of upright supports which extend upwardly from the base in the direction of the hood. One or more of the uprights is a specially designed compartment having a plurality of opposing sides which define an initially open interior space, the interior space comprising an integral oil reservoir for storing and supplying oil to the engine during normal engine operation.

Preferably, the engine is a gas powered internal combustion engine which is located on a well site for supplying power for oil and gas well operations, the engine being powered by a common oil field fuel normally present on the well site, such as, for example, natural gas, propane and methane.

In one preferred version of the prime mover design, certain of the upright supports of the housing framework comprise corner posts of the framework. At least a selected one of the corner posts comprises the specially designed compartment which serves as the integral oil reservoir for storing and supplying oil to the engine during normal engine operation. In one particularly preferred version of the design, at least selected ones of the upright supports of the housing framework comprise angle irons, the angle irons being installed through base hole openings provided in the base of the housing framework. The protruding portion of the angle irons are then ground flush, the angle irons being welded on either of two opposing sides of the base hole openings. The hood portion of the housing framework can, in some versions of the invention, be provided with an emergency stop switch which automatically disengages the transmission if the hood is lifted.

In one preferred form, the prime mover of the invention is utilized to power a pumping assembly which includes a supporting post and a walking beam, and having a head end and a tail end, pivotally connected to the post to allow for rocking of the beam about a horizontal pivot axis between positions in which the head end is up and the tail end is down and positions in which the head end is down and the tail end is up. The head end is connected to a vertical pump rod string, the lower end of which is connected to a lift pump disposed near the bottom of a well. The walking beam is also connected to one end of an arm, the opposite end of which is connected to a drive assembly for rocking the beam about the horizontal pivot axis to reciprocate the pump rod string. The drive assembly includes the prime mover of the invention which is connected by a clutch mechanism to a transmission assembly jack shaft whereby work produced by the prime mover is translated into a longitudinal force on the arm for rocking of the beam.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

DETAILED DESCRIPTION OF THE INVENTION

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of ways in which the invention herein may be practiced and to further enable those of skill in the art to practice the embodiments herein. Accordingly, the examples should not be construed as limiting the scope of the claimed invention.

As has been briefly described in the Background Discussion, the present invention deals with "prime movers" of the type used to supply power for a variety of industrial applications, such as the requirement for powering various component pieces of equipment present on an oil or gas well drilling or production site. For example, such prime movers can be used to power gas compressors of the type used to compress produced natural gas which is being sent down a gas transmission line. A large number of other uses can be envisioned, as well. For purposes of explaining the advantages of the invention, the environment of use of the prime mover will be described in terms of a pumping unit of the type associated with a "walking beam" type oil and gas well pump jacks.

For example, as has been briefly described, the pumping unit may include a supporting post and a walking beam, having a head end and a tail end, pivotally connected to the post to allow for rocking of the beam about a horizontal pivot axis between positions in which the head end is up and positions in which the head end is down. The head end of the walking beam is connected to a vertical pump rod string at the lower end of which is connected a lift pump of any desired design. The walking beam may also be connected to one end of an arm the opposite end of which is connected to the gearbox of a drive assembly for rocking of the beam about its horizontal pivot axis and to reciprocate and produce a predetermined number of up and down strokes per minute of the pump rod. In addition to the gearbox, the drive assembly includes the prime mover of the invention which is connected to the gear box by sheaves and belts. This arrangement is typical of the prior art pumping assemblies of the type under consideration, with the exception of the improvements which have been made in the prime mover of the invention.

Figure 1:
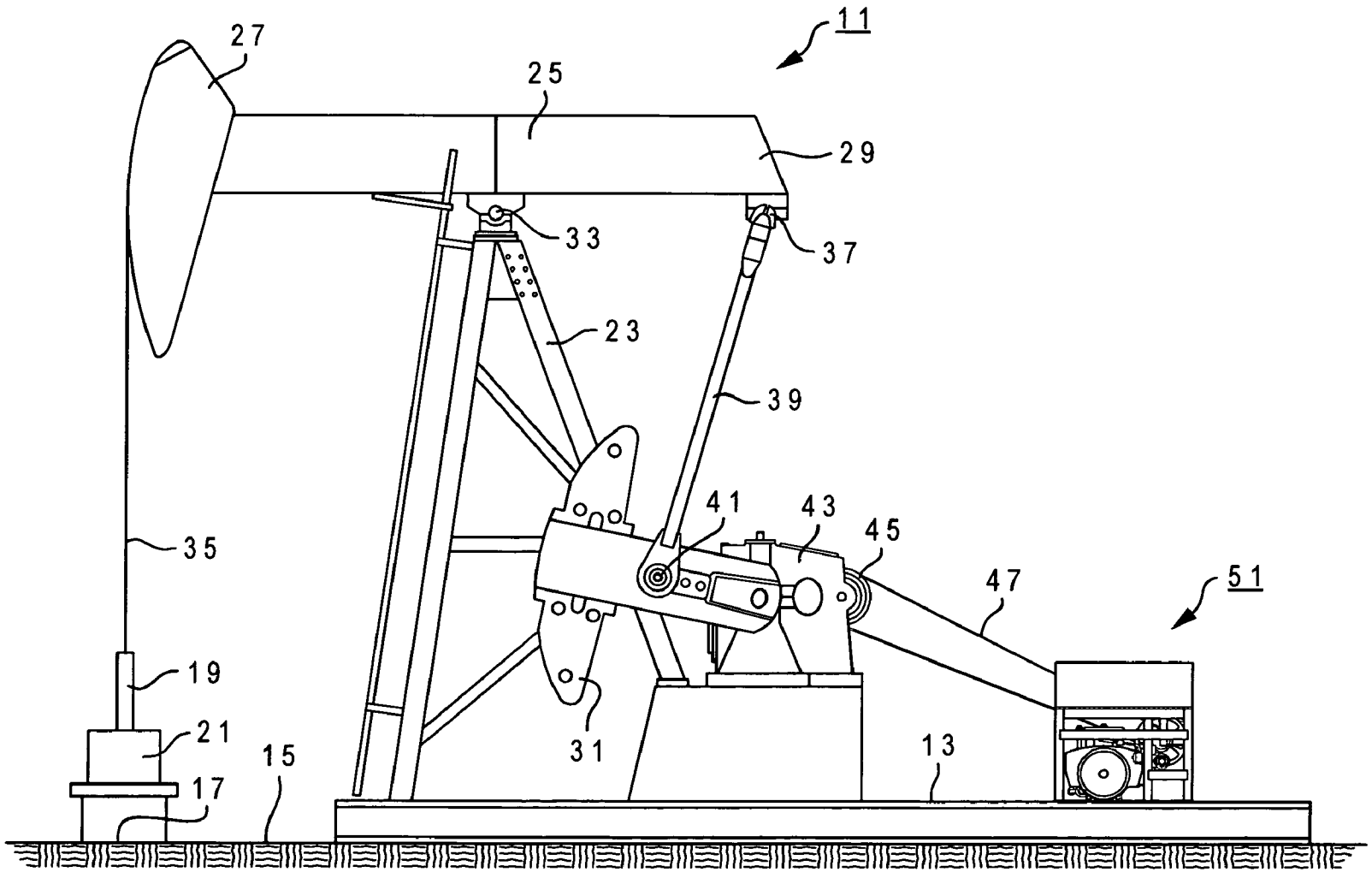
FIG. 1 is a simplified view of a pump jack being used to lift well gases or liquids to the well surface, the pump jack being powered by the prime mover of the invention through a series of sheaves and belts.

In order to further explain the general environment of the invention reference will now be had to FIG. 1 of the drawings. FIG. 1 shows a pumping unit or pump jack 11 supported on a base 13 at the surface 15 of an oil or gas well 17 in which is disposed a conventional lift pump (not shown) attached to a reciprocating pump rod string. The top of the pump rod string 19 projects upwardly through a well head 21 for connection to the pump jack 11. The pump jack 11 may comprise a supporting post 23 and a walking beam 25 having a head end 27 and a tail end 29. Typically a counterweight 31 of some type is mounted near the tail end of the walking beam 25. The walking beam 25 is pivotally attached to the post 23 by a pivot connection 33 of some type to allow for rocking of the beam 25 about a horizontal pivot axis between positions in which the head end 27 is up and the tail end 29 is down and positions in which the head end is down and the tail end is up. The result is a reciprocating motion when viewed from the side. The top of the pump rod string 19 is connected by a cable 35, or other connector, to the head end 27 of the walking beam 25. Thus, rocking of the walking beam 25 causes the pump rod string 19 to reciprocate up and down within the well.

The walking beam 25 is also connected by another pivot connection 37 to an arm member 39 which is in turn connected by another pivot connection 41 of some type to the output of a gearbox or power transmission assembly 43. Input to the gearbox or power transmission assembly is provided by a large sheave 45 connected by one or more belts 47 to one or more sheaves (63 in FIG. 2) attached to the shaft of a power device such as the prime mover 51.

Figure 2:
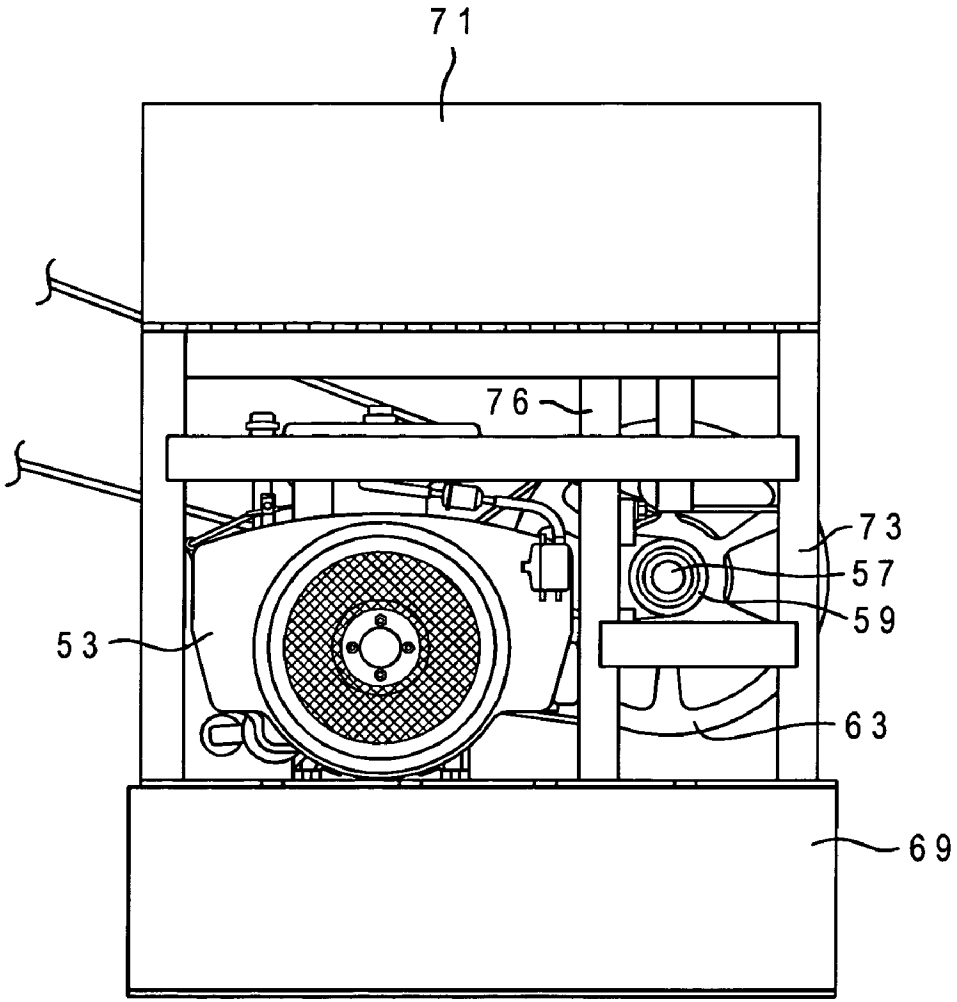
FIG. 2 is a close-up, side view of the prime mover of FIG. 1, showing the principal internal components thereof.
Figure 3:
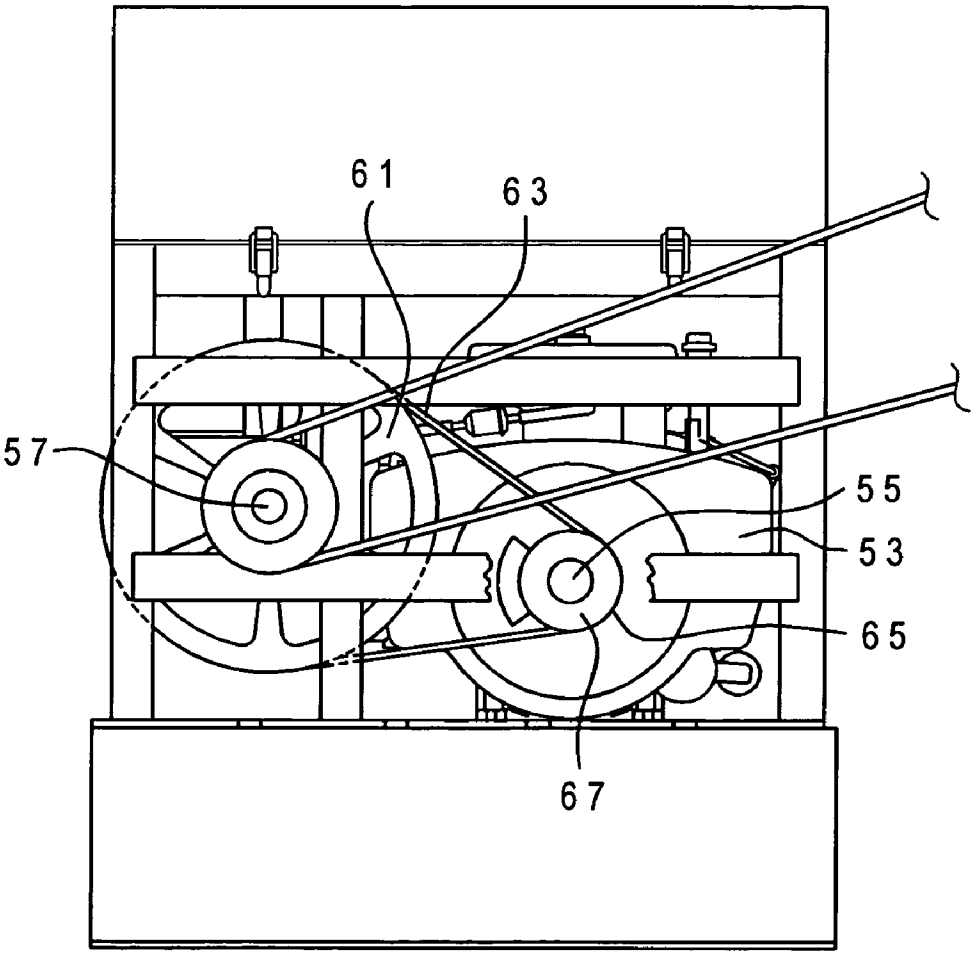
FIG. 3 is a side view, similar to FIG. 2, of the opposite side of the prime mover of FIG. 1.

Turning to FIGS. 2 and 3, there is shown the prime mover 51 of the invention in greater detail. The prime mover 51 includes an engine 53 as one of its principal components. While a variety of engine types might be utilized, the engine 53 is preferably an internal combustion engine having an output shaft (generally at 55 in FIG. 3). As will be explained in greater detail, the engine 53 is cooled by engine oil which is supplied from an oil reservoir to the engine and circulated by an oil pump which is provided as a part of the off-the-shelf internal combustion engine. Most preferably, where the engine 53 is located on a well site for supplying power for oil and gas well operations, the engine is a gas powered internal combustion engine which can be powered by a common oil field fuel normally present on the well site, for example, natural gas, propane or methane. In one preferred form of the invention, the engine 53 is a twelve volt electric start air cooled engine which is provided in, for example, 20, 25 and 32 horse power sizes. A 25 or 30 amp charging system is used to charge a conventional automobile battery which serves as a DC power source for the unit.

The unit also features a jack shaft transmission including a jack shaft 57 which is mounted in a bearing assembly 59 which allows rotational movement of the jack shaft. The jack shaft 57 is preferably a heavy duty 1½ inch ground and polished keyed shaft with a full keyway for right or left hand applications. A large B groove pulley or sheave 61 (FIG. 3) is mounted on the jack shaft and is connected to the output shaft 55 of the internal combustion engine 53 by a drive belt 63.

An optional component of the primer mover is the clutch mechanism 65 which can be a conventional commercially available electrical or mechanical clutch mechanism. The clutch mechanism 65 includes a drive sheave 67 which is turned by a drive belt (not shown) which is also driven by the engine output shaft 55. The clutch mechanism in the embodiment illustrated features a heavy duty primary clutch and a dual B series of Kevlar drive belts. The primary purpose of the clutch mechanism 65 is to serve as a speed reduction unit positionable between the power source, e.g. the internal combustion engine 53 and the power assembly or gearbox (43 in FIG. 1) of the pump jack. The prime mover may also optionally be equipped with a secondary heavy duty clutch which operates in the same manner as the primary clutch, but is used for water transfer, driving a compressor or small water injections pumps. Each of the major components of the prime mover, i.e., the internal combustion engine, jack shaft/bearing assembly and clutch mechanism, is commercially available from Graham Equipment Manufacturing Ltd., 401 4$^{th}$ Street, Graham, Tex. 76450.

Figure 4:
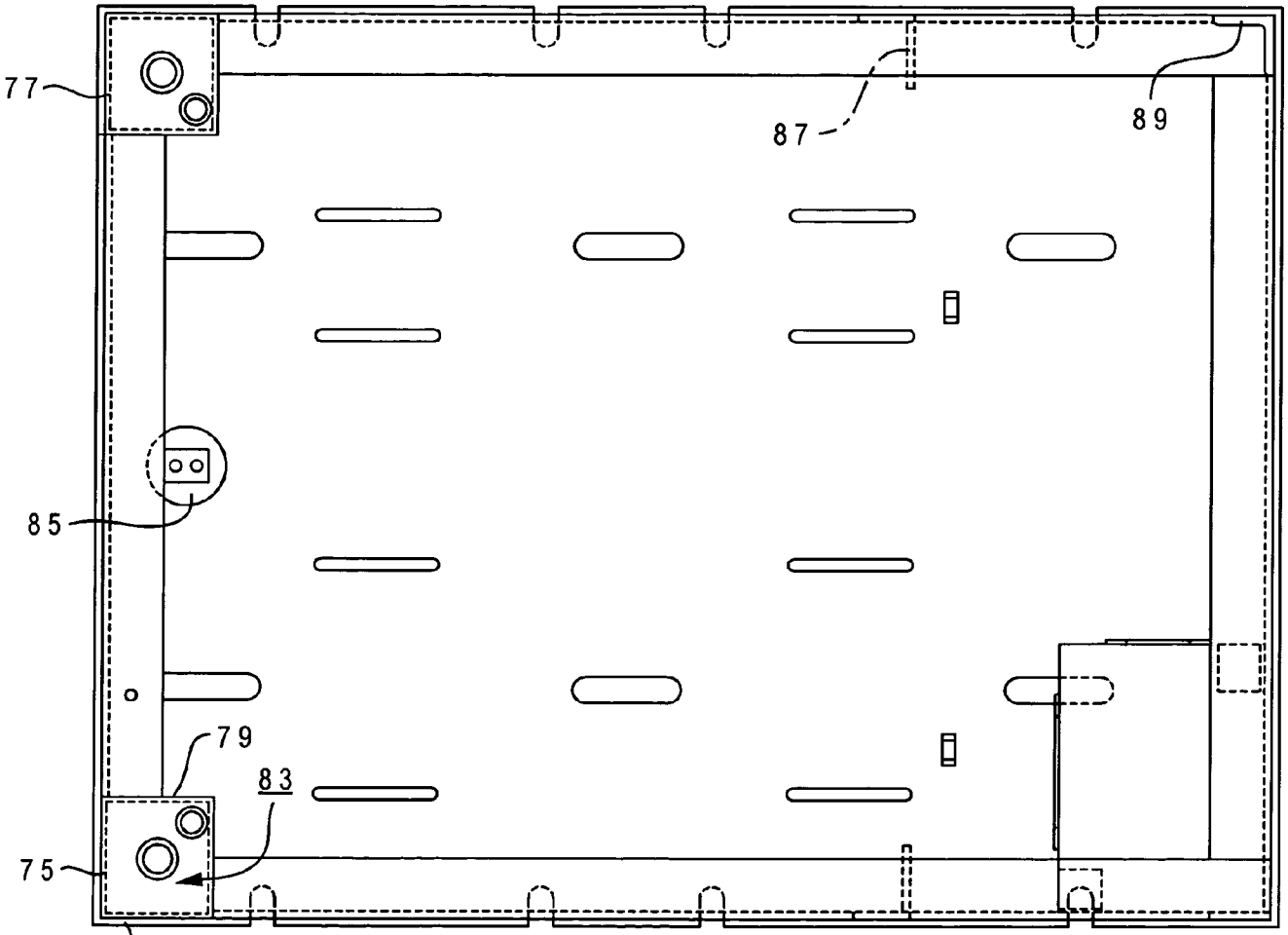
FIG. 4 is a top view of the base and uprights of the housing framework which encloses the principle components of the prime mover, where two of the corner posts of the housing framework form the specially designed integral oil reservoirs used for storing and supplying oil to the engine during normal engine operation.
Figure 5:
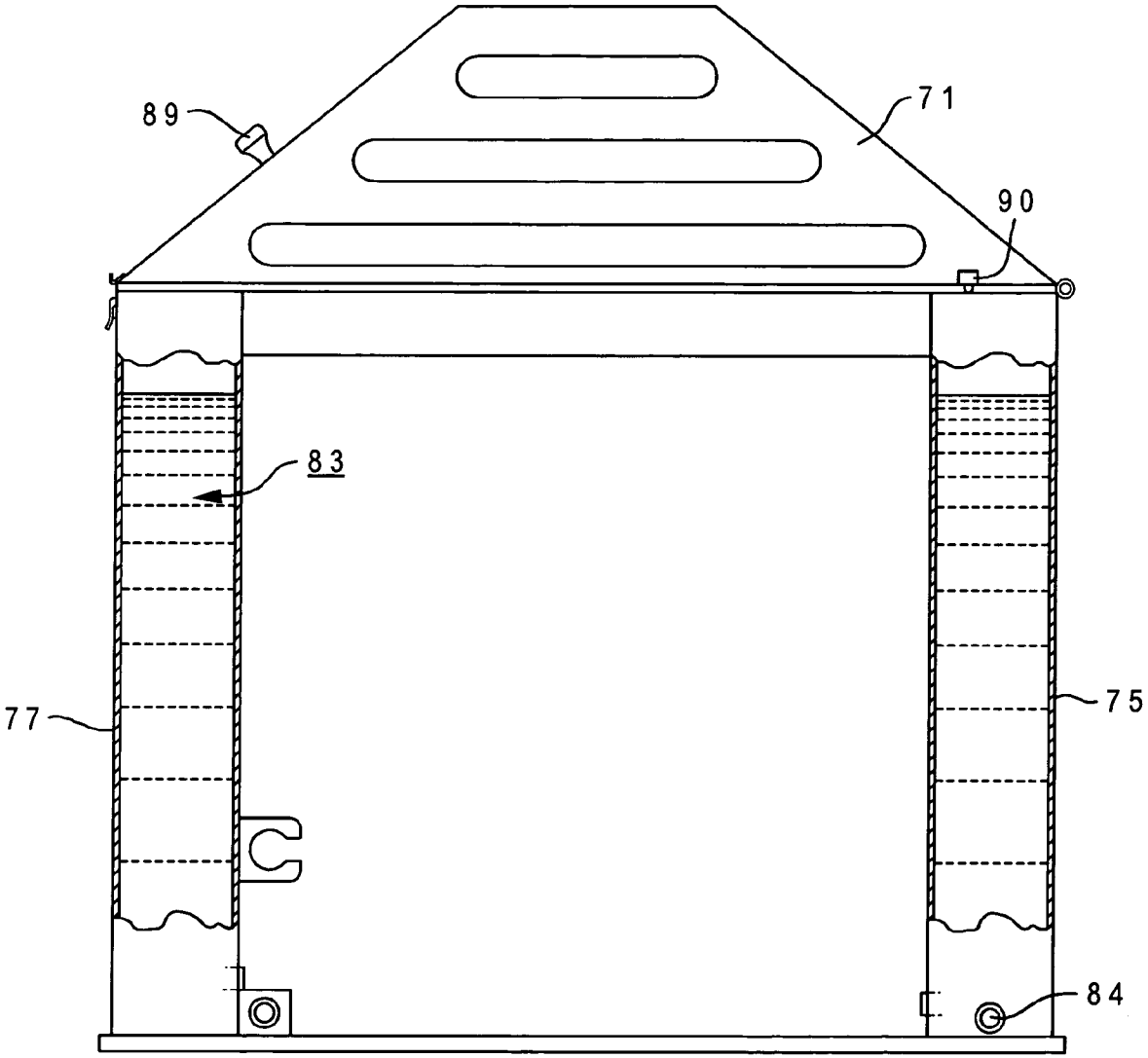
FIG. 5 is an end view of the housing framework of FIG. 3, showing the corner posts which form the internal oil reservoirs of the unit.

As will be appreciated from FIGS. 2-5, the prime mover principal components are enclosed by means of a housing framework. Referring to FIG. 2, the housing framework includes a base 69, a hood 71 and a plurality of upright supports which extend upwardly from the base 69 in the direction of the hood 71. As can be seen best in FIGS. 4 and 5, at least certain ones of the upright supports of the housing framework comprise corner posts (such as upright supports 75, 77) of the framework. At least a selected one of the corner post comprises a specially designed compartment having a plurality of opposing sides, such as sides 79, 81 shown in FIG. 4. The opposing sides define an initially open interior space 83 which is generally an elongated rectangular column when viewed from the side. The interior space 83 comprises an integral oil reservoir for storing and supplying oil to the internal combustion engine 53 during normal engine operation. With reference to FIG. 5, the column 75 is equipped with one or more ports 84 which provide fluid communication by means of suitable conduits and allow circulation of oil in the interior space thereof between the internal combustion engine and typically a replaceable oil filter cartridge. The location of the oil filter cartridge can be, for example, as indicated generally at 85 in FIG. 4, or in some cases is located at the engine itself.

The additional space provided by the columns 75, 77 allows the primer mover to be supplied with, for example, a seven to sixteen quart oil system with an oil dipstick. Because a greater volume of oil is present in the system, the oil change interval can be extended from a typical 200 hour interval to approximately 1500-2000 hour intervals, or more. Because of the built in oil reservoir within the housing framework, more oil is present to circulate through the engine, which allows the engine to run cooler, thereby extending engine life.

As will be appreciated with respect to FIGS. 2-4, at least selected ones of the upright supports, e.g. supports 76, comprise angle irons. The angle irons are installed through base hole openings, such as openings 87, 89, provided in the base of the housing framework. The exposed ends of the angle irons are then ground flush and the angle irons are welded on either of the top and bottom opposing sides of the base hole openings. This provides an extremely strong housing framework with support columns which will not break off easily.

The prime mover can also be provided with an emergency stop switch (89 in FIG. 5) which is located on the hood 71 of the housing framework and which safely kills the internal combustion engine 53 when the switch is pressed down. Also, another hood switch is provided on most models located at 90 on hood 71 in FIG. 5. This switch effectively turns off the pulley shaft and keeps the dry pulleys from turning.

In operation, the engine oil pump (not shown) forces oil out of the engine to a first reservoir (e.g., reservoir 75 in FIG. 4). It is then routed out through a rubber hose or other conduit to an outlet port, such as port 84 in FIG. 5, to a corresponding inlet port in the additional column 77, if so equipped. The oil then flows through hose or other suitable flow conduit to the oil filter cartridge 85, after which it is circulated back to the engine. It will be understood that while two reservoirs are illustrated in the drawings, the prime mover could also be operated with a single reservoir or with additional reservoirs.

An invention has been provided with several advantages. The primer mover of the invention can be run on common oil field fuels including natural gas, propane or methane and provides a powerful state of the art system for maximizing production and increasing labor efficiency. The novel oil storage reservoirs which are provided as an integral part of the framework housing of the unit extend the typical oil change interval for up to 1500 hours or more. The emergency stop, provided as a push switch on the hood of the unit, shuts down the entire system if the hood is raised. The method of assembling the upright supports in the base hole openings provides an exceptional sturdy housing which can withstand a variety of loads or forces.

While the invention has been shown in only one of its forms, it is not thus limited but is susceptible to various changes and modifications without departing from the spirit thereof.

What is claimed is:

1. A prime mover of the type used to supply power in industrial applications, the prime mover comprising:

an internal combustion engine having an output shaft, the engine being cooled by engine oil supplied from an oil reservoir to the engine and circulated by an oil pump;

a jack shaft mounted in a bearing assembly which allows rotational movement of the jack shaft;

a sheave mounted on the jack shaft, the sheave being connected to an output shaft of the internal combustion engine by a drive belt;

a housing framework which encloses the engine and supports the jack shaft bearing assembly, the housing framework including a base, a hood and a plurality of upright supports which extend upwardly from the base in the direction of the hood; and wherein one or more of the uprights is a specially designed compartment having a plurality of opposing sides which define an initially open interior space, the interior space comprising an integral oil reservoir for storing and supplying oil to the engine during normal engine operation.

2. The prime mover of claim 1, wherein the engine is a gas powered internal combustion engine.

3. The prime mover of claim 1, wherein the prime mover is located on a well site for supplying power for oil and gas well operations, the prime mover being powered by a common oil field fuel normally present on the well site, the fuel being selected from the group consisting of natural gas, propane and methane.

4. The prime mover of claim 1, wherein certain of the upright supports of the housing framework comprise corner posts of the framework, at least a selected one of the corner posts comprising the specially designed compartment which serves as the integral oil reservoir for storing and supplying oil to the engine during normal engine operation.

5. The prime mover of claim 1, wherein an emergency stop switch is located on the hood of the housing framework which kills the engine is the switch is pressed down.

6. The prime mover of claim 1, wherein the prime mover also includes a clutch operatively associated with the engine and jack shaft for controlling the speed of rotation of the jack shaft, and wherein the prime mover further comprises a hood switch which automatically disengages the clutch and stops the rotation of the jack shaft when actuated.

7. The prime mover of claim 1, wherein at least selected ones of the upright supports of the housing framework comprise angle irons, the angle irons being installed through base hole openings provided in the base of the housing framework and are then ground flush, the angle irons being welded on either of two opposing sides of the base hole openings.

8. A prime mover of the type used to supply power in industrial applications, the prime mover comprising:

an internal combustion engine having an output shaft, the engine being cooled by engine oil supplied from an oil reservoir to the engine and circulated by an oil pump;

a jack shaft mounted in a bearing assembly which allows rotational movement of the jack shaft;

a sheave mounted on the jack shaft, the sheave being connected to an output shaft of the internal combustion engine by a drive belt;

a clutch operatively associated with the engine and jacks shaft for controlling the speed of rotation of the jack shaft;

a housing framework which encloses the engine and supports the jack shaft bearing assembly, the housing framework including a base, a hood and a plurality of upright supports which extend upwardly from the base in the direction of the hood;

wherein one or more of the uprights is a specially designed compartment having a plurality of opposing sides which define an initially open interior space, the interior space comprising an integral oil reservoir for storing and supplying oil to the engine during normal engine operation;

an oil filter mounted within the housing frame work, the oil filter being connected in a fluid flow path between the interior space of the housing oil reservoir and the engine oil pump; and wherein certain of the upright supports of the housing framework comprise corner posts of the framework, at least a selected one of the corner posts comprising the specially designed compartment which serves as the integral oil reservoir for storing and supplying oil to the engine during normal engine operation.

9. The prime mover of claim 8, wherein the prime mover is located on a well site for supplying power for oil and gas well operations, the prime mover being powered by a common oil field fuel normally present on the well site, the fuel being selected from the group consisting of natural gas, propane and methane.

10. The prime mover of claim 8, wherein an emergency stop switch is located on the hood of the housing framework which kills the engine if the switch is pressed down.

11. The prime mover of claim 8, wherein the prime mover further comprises a hood switch which automatically disengages the clutch and stops the rotation of the jack shaft when actuated.

12. The prime mover of claim 8, wherein at least selected ones of the upright supports of the housing framework comprise angle irons, the angle irons being installed through base hole openings provided in the base of the housing framework and are then ground flush, the angle irons being welded on either of two opposing sides of the base hole openings.

13. A pumping assembly including a supporting post and a walking beam, having a head end and a tail end, pivotally connected to the post to allow for rocking of the beam about a horizontal pivot axis between positions in which the head end is up and the tail end is down and positions in which the head end is down and the tail end is up, the head end being connected to a vertical pump rod, the lower end of which is connected to a lift pump disposed near the bottom of a well, the walking beam also being connected to one end of an arm, the opposite end of which is connected to a drive assembly for rocking the beam about the horizontal pivot axis to reciprocate the pump rod, the drive assembly including a prime mover connected by sheaves and belts to a transmission assembly whereby work produced by the prime mover is translated into a longitudinal force on the arm for rocking of the beam, the prime mover comprising:

an internal combustion engine having an output shaft, the engine being cooled by engine oil supplied from an oil reservoir to the engine and circulated by an oil pump;

a jack shaft mounted in a bearing assembly which allows rotational movement of the jack shaft;

a sheave mounted on the jack shaft, the sheave being connected to an output shaft of the internal combustion engine by a drive belt;

a housing framework which encloses the engine and jack shaft bearing assembly, the housing framework including a base, a hood and a plurality of upright supports which extend upwardly from the base in the direction of the hood; and wherein one or more of the uprights is a specially designed compartment having a plurality of opposing sides which define an initially open interior space, the interior space comprising an integral oil reservoir for storing and supplying oil to the engine during normal engine operation.

* * * * *